United States Patent [19]

Luger

[11] Patent Number: 4,970,880

[45] Date of Patent: Nov. 20, 1990

[54] WASHING MACHINE LINT TRAP

[76] Inventor: Joseph L. Luger, 2801 Knollcrest Dr., Burlington, Wis. 53105

[21] Appl. No.: 391,996

[22] Filed: Aug. 10, 1989

[51] Int. Cl.[5] ..... D06F 39/10

[52] U.S. Cl. ..... 68/208; 210/460

[58] Field of Search ..... 68/208; 137/147, 565, 137/263; 210/463, 460, 459, 461

[56] References Cited

U.S. PATENT DOCUMENTS

| | | | |
|---|---|---|---|
| 2,391,561 | 12/1945 | Geldhof et al. | 68/208 |
| 2,512,394 | 6/1950 | Sullivan | 68/208 |
| 2,586,508 | 2/1952 | Brotman | 68/208 |
| 2,809,050 | 10/1957 | Anderson | 68/208 |
| 2,884,947 | 5/1959 | Gerhardt | 68/208 |
| 3,487,944 | 1/1970 | Tucker | 210/463 |
| 3,526,323 | 9/1970 | Smith | 210/460 |
| 3,762,562 | 10/1973 | Okuniewski et al. | 210/460 |
| 3,959,138 | 5/1976 | Nichols | 210/460 X |
| 3,960,733 | 6/1976 | Van Dieren | 210/460 |
| 4,123,361 | 10/1978 | Marschman | 210/463 |
| 4,505,138 | 3/1985 | Lang | 68/208 |
| 4,523,992 | 6/1985 | Sackett | 210/463 |

*Primary Examiner*—Frankie L. Stinson

*Attorney, Agent, or Firm*—Peter N. Jansson, Ltd.

[57] ABSTRACT

An improved washing machine lint trap, of the type connected to the discharge hose, is characterized by a tube-like structure having an expandable perforated side wall which, when an excess of lint accumulates, expands to enlarge the perforations through which wash water flows, thereby to allow extended use and prevent clogging. Preferred embodimens are made of an expandable tubular mesh, most preferably with diamond-shaped perforations. The mesh is preferably of a color which contrasts with lint to facilitate visual ascertainment of the extent of filling.

2 Claims, 2 Drawing Sheets

WASHING MACHINE LINT TRAP

FIELD OF THE INVENTION

This invention relates to trapping lint discharged from a washing machine. More specifically, the invention relates to filtering devices located on washing machine discharge conduits which empty into sinks, basins or the like.

BACKGROUND OF THE INVENTION

One of the well-known problems with clothes washing machines is that as water is discharged it carries with it lint from the clothes it has washed. This discharged lint can cause problems with drains, pipes, pumps, and septic tanks in a drainage system. If this lint can be trapped by filtering before discharge of water, some of the problems can be eliminated.

The ideal point for this filtering to occur is on discharge from the washing machine outlet hose or other discharge line. Effective filtering can occur at the terminal end of the washing machine discharge hose, as water empties into the sink or basin.

A number of devices have been developed and used for this purpose over the years, including some for which United States patents have been granted and others which are simple home-made attempts too provide suitable filters.

U.S. Pat. No. 3,487,944 shows a trap designed to filter lint. However, the devices of such patent would require continual maintenance to be effective. This trap would not fit all conventional washing machine discharge hoses and, for the average person, could be a problem to install and maintain.

U.S. Pat. No. 3,769,818 discloses a device designed for internal use within the washing machine. Such device cannot be used unless the machine is manufactured with the device already installed.

Other devices have been used as well. One common expedient is to secure some sort of cloth filter over the terminal end of the discharge conduit. For example, women's nylon hosiery is frequently used for this purpose. However, such devices have significant drawbacks and potential problems in many cases. Clogging can occur, thus impeding discharge of water. At the extreme, such clogging can cause damage to the washing machine because of the inability under such conditions to evacuate itself.

Although these and other prior devices have some merit in dealing with the lint problem, they have not provided a fully satisfactory solution. One problem is that many washing machine filter devices of the prior art have little capacity for trapping lint. That is, they become full of, and clogged with, lint in a short period, thus requiring frequent attention. And, when ignored too long, blockage problems could cause damage to the washing machines or their surroundings.

An improved washing machine lint trap which has high capacity for extended use and avoids the aforementioned clogging problems is needed. The device should be easy to install and the extent of lint accumulation on it should be easily ascertainable.

OBJECTS OF THE INVENTION

Thus, it is an object of this invention to provide an improved washing machine discharge filter device overcoming certain problems and shortcomings of the prior art, including those mentioned above.

One object of this invention is to provide a lint trap which is simple to install and use on all washing machines.

Another object of this invention is to provide an improved high-capacity lint trap for extended washing machine discharge filtration.

Another object is to provide an improved lint trap which avoids clogging problems.

Another object of this invention is to provide an improved lint trap which allows easy visual ascertainment of the condition of the filter.

Another object of this invention is to provide an improved filtration device for extended effective lint filtration without damage to the washing machine or its surroundings.

A further object of this invention is to provide a lint removal device which is of simple, inexpensive construction.

SUMMARY OF THE INVENTION

This invention is an expandable tube-like lint trap, for attachment to the discharge hose of a washing machine, having a plurality of openings (perforations) which enlarge as substantial amounts of lint accumulate, thereby to allow water passage to continue in order to avoid clogging.

The side wall of the tube-like trap is preferably an expandable mesh which forms the perforations. The mesh is constructed and arranged such that the perforations enlarge as the side wall expands. The perforations are preferably diamond-shaped, such diamond-shaped openings providing better filtration than many previous traps.

The unique expandable lint trap of this invention is simple and yet is a particularly effective lint filtration device which satisfies all of the aforementioned objects of the invention.

This inventive lint trap, which is preferably made of a bright color contrasting sharply with the color of lint, can be secured to the discharge hose of any washing machine by means of a simple clamping device. During operation of the washing machine, water and lint are discharged into the trap. The preferred unique mesh side wall and expandable diamond-shaped openings, while of substantial size (compared to most filter openings), will restrict small particles of lint from passing through the trap. As the trap fills with lint, the extent to which the trap is filled with lint can easily be visually observed by virtue of the color contrast of lint and trap mesh. At the proper maintenance interval, the trap may be cleaned or replaced.

DETAILED DESCRIPTION OF PREFERRED EMBODIMENTS

Figure 1:
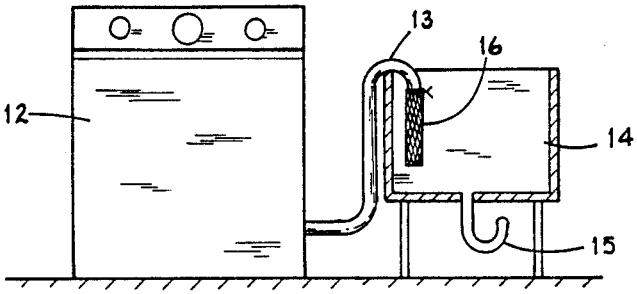
FIG. 1 is a reduced-scale, partially sectional, front elevational view of the improved lint trap of this invention attached to a washing machine discharge hose and its use in a sink.

A conventional washing machine 12 has a discharge conduit (hose) 13 through which water and lint pass as wash water empties into a sink 14 with drain 15. A tube-like lint trap 16, made in accordance with this invention, is secured over the terminal end 13A of discharge hose 13 so that wash water will pass through the perforations 20 in the side wall of trap 16 before entering sink 14.

As water and lint flow into and attempt to pass through perforations 20, water passes through perforations 20 of trap 16 while lint is restricted. Wash water continues to flow through these perforations 20 and into sink 14, while lint accumulates in trap 16. Trap 16 can eventually be cleaned or replaced.

Figure 2:
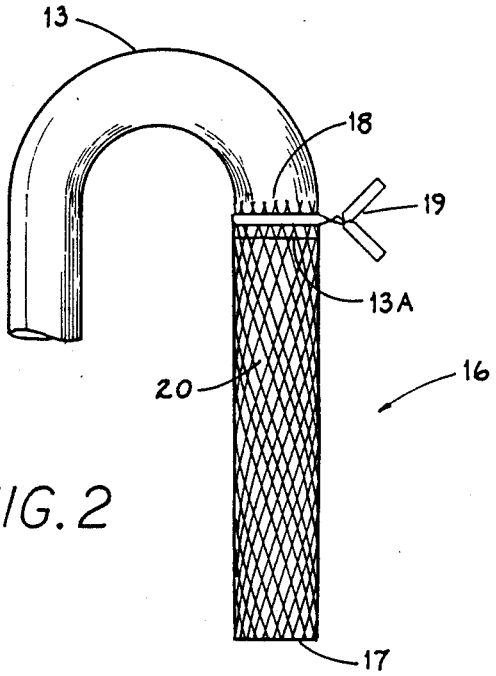
FIG. 2 is an enlarged fragmentary view of the trap of FIG. 1.

Lint trap 16 is preferably made of a colored plastic in the form of tubular mesh 30. As shown in FIGS. 1 and 2, the mesh tube is sealed at its distal end 17 and is open at its proximal end 18 for attachment to hose 13. Preferred materials for mesh 30 include flexible plastics, fiber or other expandable material, with diamond-shaped openings 20. Suitable materials would be apparent to those skilled in the art who are familiar with this invention.

Open end 18 of trap 16 fits over discharge hose 13 and is secured thereto by tie 19. Tie 19 supports the weight of the trap, including trapped lint, and holds trap 16 on discharge hose 13. This tie can be any tie will known in the art. It will, of course, be understood that, in lieu of the tie, the trap assembly may receive some other means of support, with all other elements remaining essentially the same as shown and described.

Figure 3:
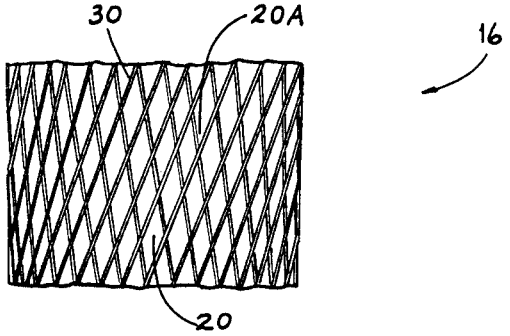
FIG. 3 is an enlarged fragmentary front elevation (without background), illustrating a portion of the trap side wall.
Figure 4:
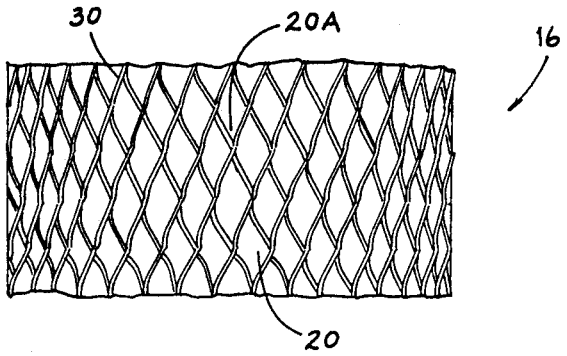
FIG. 4 is a similar view, but showing the trap in partially expanded condition.

As shown best in FIGS. 3 and 4, perforations 20 are configured to prevent lint from passing through the trap side wall. The side wall of trap 16 will continue to accumulate lint over a long period of time. The internal pattern and texture of this perforated side wall create the ability to filter lint from water. It is believed that the preferred diamond-shape of perforations 20 enhance the ability of trap 16 to collect lint. Such perforations present a great many V-shaped downstream ends 20A of perforations 20 which face the flow of wash water. This facilitates lint collection.

As some of these openings are filled with lint, others serve to trap additional lint. And, if the trap remains in place for extended use, beyond the recommended maintenance interval, the trap side wall starts to expand to let water continue to escape from the trap.

The foregoing description of the preferred embodiment of the invention has been presented for the purposes of illustration and description. It is not intended to be exhaustive or to limit the invention to the precise form disclosed. Many modifications and variations are possible, and are within the scope of this invention.

I claim:

1. In a washing machine lint trap apparatus of the type including a tube-like lint trap member, the improvement comprising:

a washing machine discharge hose having an open terminal end; and a lint-trap tube having an open proximal end secured directly to the discharge hose terminal end without intervening coupling tube, a closed distal end spaced from the terminal end of the hose, and a side wall extending between the proximal and distal ends, said side wall being a substantially expandable flexible plastic mesh forming diamond-shaped perforations with spreadable V-shaped downstream ends facing water flow and positioned to collect lint, whereby, as lint accumulates and is closing said perforations, substantial side wall expansion greatly enlarges the perforations, allowing unimpeded water passage to continue and clogging to be avoided without significant pressure build-up which could impair the connection between the hose and the lint trap tube.

2. The washing machine lint trap apparatus of claim 1 wherein the mesh is made of a color providing visual color contrast to lint, thereby to facilitate visual ascertainment of the extent to which the trap is full of lint.

* * * * *